US005567118A

United States Patent [19]

Grgurich et al.

[11] Patent Number: 5,567,118

[45] Date of Patent: Oct. 22, 1996

[54] NON-LUBRICATED, AIR-ACTUATED, PUMP-OPERATING, SHUTTLE VALVE ARRANGEMENT, IN A RECIPROCATING PUMP

[75] Inventors: Keith A. Grgurich, Cincinnati; Graydon W. Cole, West Chester, both of Ohio

[73] Assignee: ITT Fluid Technology Corporation, Midland Park, N.J.

[21] Appl. No.: 388,091

[22] Filed: Feb. 14, 1995

[51] Int. Cl.[6] ..... F04B 49/00; F04B 17/00

[52] U.S. Cl. ..... 417/46; 417/393

[58] Field of Search ..... 417/46, 389, 393; 91/309, 313, 329

[56] References Cited

U.S. PATENT DOCUMENTS

| | | | |
|---|---|---|---|
| 3,838,946 | 10/1974 | Schall | 417/395 |
| 4,494,574 | 1/1985 | Casilli | 417/393 |
| 4,555,222 | 11/1985 | Casilli | 417/393 |
| 4,854,832 | 8/1989 | Gardner et al. | 417/393 |
| 5,232,352 | 8/1993 | Robinson | 417/393 |
| 5,277,555 | 1/1994 | Robinson | 417/393 |

*Primary Examiner*—Timothy S. Thorpe
*Assistant Examiner*—Xuan M. Thai
*Attorney, Agent, or Firm*—Menotti J. Lombardi

[57] ABSTRACT

A pilot spool is interposed between the compressed air supply and the diaphragm pump-operating main spool, to insure that, at any one time, only one end of the bore in which the main spool reciprocates receives the compressed air. The pilot spool has an annular recess of a length which does not bridge across passageways which admit the air to the main spool, so alternatively, each passageway opens onto an end of the main spool bore. The reciprocating pump structure, that is, the double diaphragms, shaft, and clamp plates, cause the pilot spool to shift, to communicate one of the passageways, with each shift, with the air supply and the main spool bore. No lubrication is provided or needed, and the pilot spool insures that the main spool will not stall.

6 Claims, 2 Drawing Sheets

NON-LUBRICATED, AIR-ACTUATED, PUMP-OPERATING, SHUTTLE VALVE ARRANGEMENT, IN A RECIPROCATING PUMP

BACKGROUND OF THE INVENTION

This invention pertains to reciprocating pumps, generally, such as compressed air-operated, double-diaphragm pumps, having a pump-operating, main spool valve or shuttle valve, and in particular to such a non-lubricated, air-actuated, pump-operating, shuttle valve arrangement, in a reciprocating pump.

Compressed air-operated, diaphragm pumps are susceptible to stalling; stalling occurs when the pump-operating main spool or shuttle valve becomes halted at the midpoint of its reciprocating motion in its bore. In this circumstance, the pump is prevented from restarting without repositioning the stalled main spool or shuttle valve. This condition can occur when the compressed air source is interrupted with the pump running, or when there is a low air supply pressure. In prior art pump designs which incorporate shuttle valves or shafts which use O-rings in dynamic sealing conditions, the O-rings can become set, during periods of non-use, or the shaft can become frozen in position so as to become "stalled". Manufacturers of these prior art designs, even though they claim lubrication free configurations, must use oil or grease of some kind to lessen such stalling. Restarting of these designs, if possible, would require significantly higher than normal operating inlet air supply pressures.

Prior art, air-operated, diaphragm pumps, typically, are unable to operate at low inlet air supply pressures, and they are known to be susceptible of unreliable operation at extremely low pump discharge flow rates. Too, the prior art, air-operated, diaphragm pumps have an inability to operate smoothly and reliably during constant, start-stop, duty cycles.

Most current versions of air-operated, diaphragm pumps utilize a lubricated pilot spool or lubricated main shaft (which also serves to pilot the main spool or shuttle valve), which requires O-rings to seal in a dynamic condition. In order to qualify for non-stall operation, the O-rings need to be lubricated by oil mist or grease pack to be able to slide without binding at low air supply pressures.

Polytetrafluorethylene-encapsulated O-rings were tried, to eliminate the need for lubrication in the aforesaid prior art pumps, but these were unsuccessful.

At least one, current, "non-stall" air valve manufacturer, which claims its pilot spool with O-rings requires no outside lubrication, requires the use of an in-line lubricator on the air supply for other than intermittent operation. For continuous operation, light oil injection is recommended.

One other, current, "non-stall" air valve manufacturer utilizes an unbalanced main spool, or shuttle valve, to allow a greater force to bias the main spool or shuttle valve in one direction to prevent centering thereof, and resultantly, stalling. This design comprises a grease pack to allow the sliding of close tolerance components to occur.

Further, current versions of such air valves utilize two spring-loaded actuators (i.e., popper valves) to shift the main spool or shuttle valve. Even though these versions were lubrication free, they had a tendency to hang-up or fail to shift completely, on low air supply pressures, or on constant start-stop operation. Since the spring in a spring-loaded popper valve allows the valve to remain open only momentarily, a low inlet air pressure condition results in an insufficient volume of air to reach the main spool or shuttle valve. Further, in these low pressure applications, this incomplete main spool shift can result in "centering" or air valve "hang-up". This low inlet air pressure condition is aggravated by designed "controlled leakage" to exhaust which reduces further the volume of air which is available to cause main spool or shuttle valve shifting. The necessity to overcome the spring force to open a spring-loaded actuator is also disadvantageous in a low supply air pressure condition.

Known, prior art embodiments of such air valves also have an inordinate number of discrete parts and components, and/or complicated arrangements and assemblies which make any routine maintenance and servicing very troublesome and expensive.

SUMMARY OF THE INVENTION

In view of the aforecited problems with prior art main spool or shuttle valve arrangements, it is an object of this invention to define an inventive embodiment of such an arrangement which obviates the prior art problems.

Particularly, it is an object of this invention to set forth a non-lubricated, air-actuated, pump-operating, shuttle valve arrangement, in a reciprocating pump, comprising a pump housing having a first bore formed therein; a pump-operating shuttle valve slidably disposed in said bore; a source of energized air; a first passageway, formed in said housing, for conducting air from said source to one end of said bore; a second passageway, formed in said housing, for conducting air from said source to the opposite end of said bore; and reciprocating means, interposed between said source and said passageways, for preventing an operative stall of said shuttle valve due to a dead centering thereof, in said bore, substantially equidistant from said one and said opposite ends of said bore.

Further objects of this invention, as well as the novel features thereof, will become apparent by reference to the following description, taken in conjunction with the accompanying figures.

DETAILED DESCRIPTION OF THE PREFERRED EMBODIMENT

Figure 1:
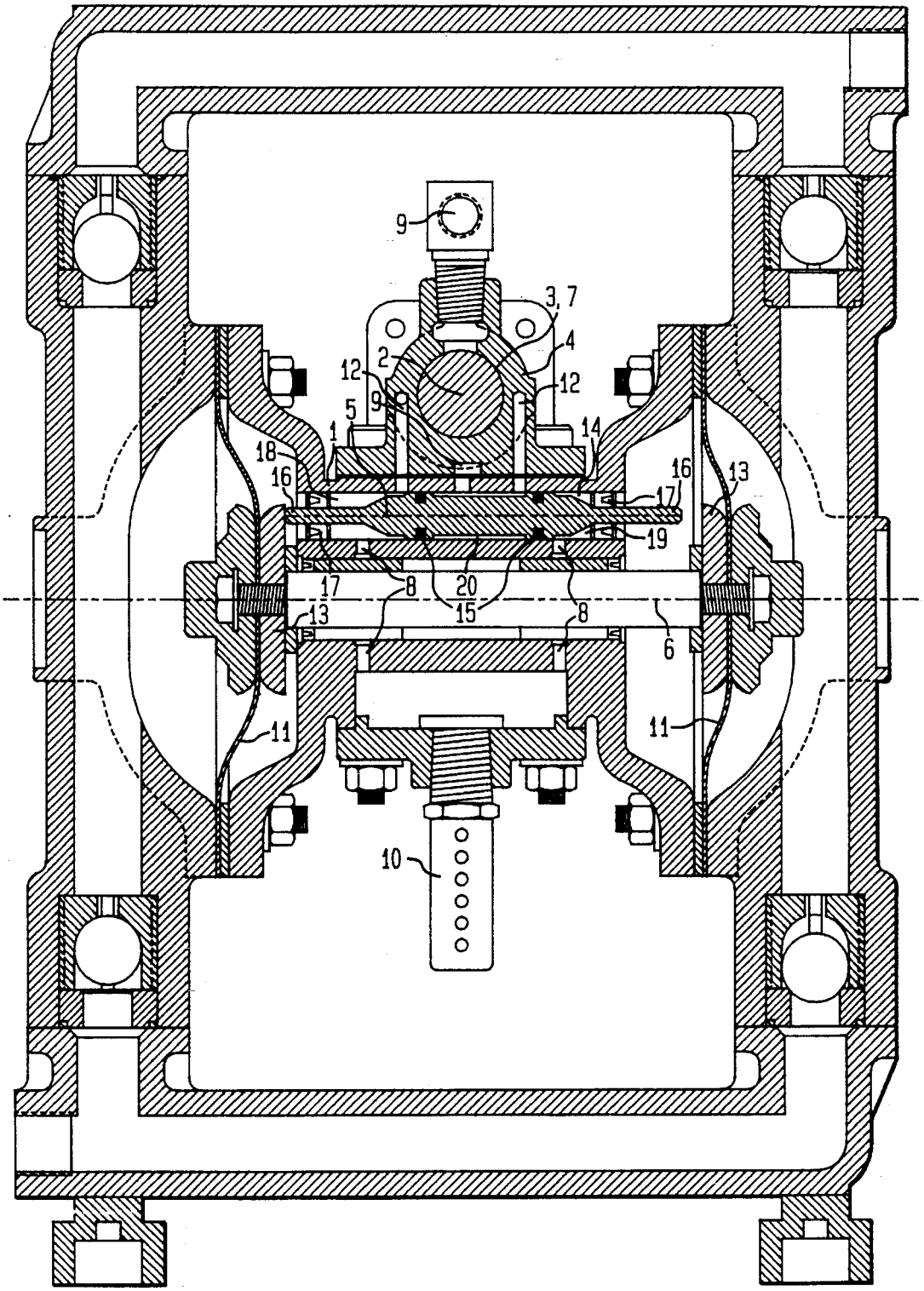
FIG. 1 is a vertical, cross-sectional view of a non-lubricated, air-actuated, pump-operating, shuttle valve arrangement, in a reciprocating pump, according to an embodiment of the invention.

Referring now to the drawings in detail, and first to FIG. 1 thereof, it will be seen that a double-diaphragm, air-operated, reciprocating pump is depicted. The pump, per se, in its general operation, is not especially germane to the present invention and, in fact, is not significantly dissimilar from prior art pumps. U.S. Pat. Nos. 4,494,574, issued to Joseph C. Casilli, et al, on 22 Jan. 1985, for a Valve Arrangement for an Air-Operated Diaphragm Pump, and 4,555,222, issued on Nov. 26, 1985, for an Air-Operated Diaphragm Pump and a Valve Arrangement Therefor, to Joseph C. Casilli, clearly describe the operation of such double-diaphragm, air-operated pumps. Accordingly, it is deemed unnecessary to detail the general functioning of the FIG. 1 double-diaphragm pump, herein, as such is known to those of ordinary skill in the relevant art. In addition, the aforesaid U.S. Pat. Nos. 4,494,574 and 4,555,222 are hereby incorporated, by reference, for any perceived background information which my be necessary to an understanding of the double-diaphragm functioning of the instant pump.

As shown in FIG. 1, there is an air distributor 1 and a main spool or shuttle valve 2, the latter being slidable in a main spool or shuttle valve bore 3 formed in the spool or shuttle valve-confining portion of the pump housing 4. A novel pilot spool 5, which is reciprocable in parallel with the main shaft 6 of the pump, serves an inventive performance of which more is detailed in the ensuing text. The main spool or shuttle valve 2 has piston rings 7 thereabout, the same being seen in FIG. 2. Air exhaust ports 8 are formed in the housing 4 and the compressed air supply 9 is conducted to the pilot spool 5 for communication thereof to one or the other end of the bore 3. An air exhaust muffler 10 is in communication with the ports 8. The diaphragms 11 are disposed astride the housing 4, the latter having a pair of passageways 12 formed in the housing for distributing the compressed air supply 9. Inner clamps plates 13 of the pump diaphragms 11 impinge against opposite-ended, extended portions of the pilot spool 5 to cause the spool 5 to reciprocate in the pilot spool bore 14 as a consequence of the reciprocation of the main shaft 6 of the pump. The pilot spool 5 has sealing piston rings 15 set thereabout, and the extended portions 16 of the pilot spool 5 have seals 17 thereabout. Rings 15 and seals 17 cooperate with the spool 5 and the bore 14 to define variable volume chambers 18 and 19 at opposite ends of the bore 14.

Figure 2:
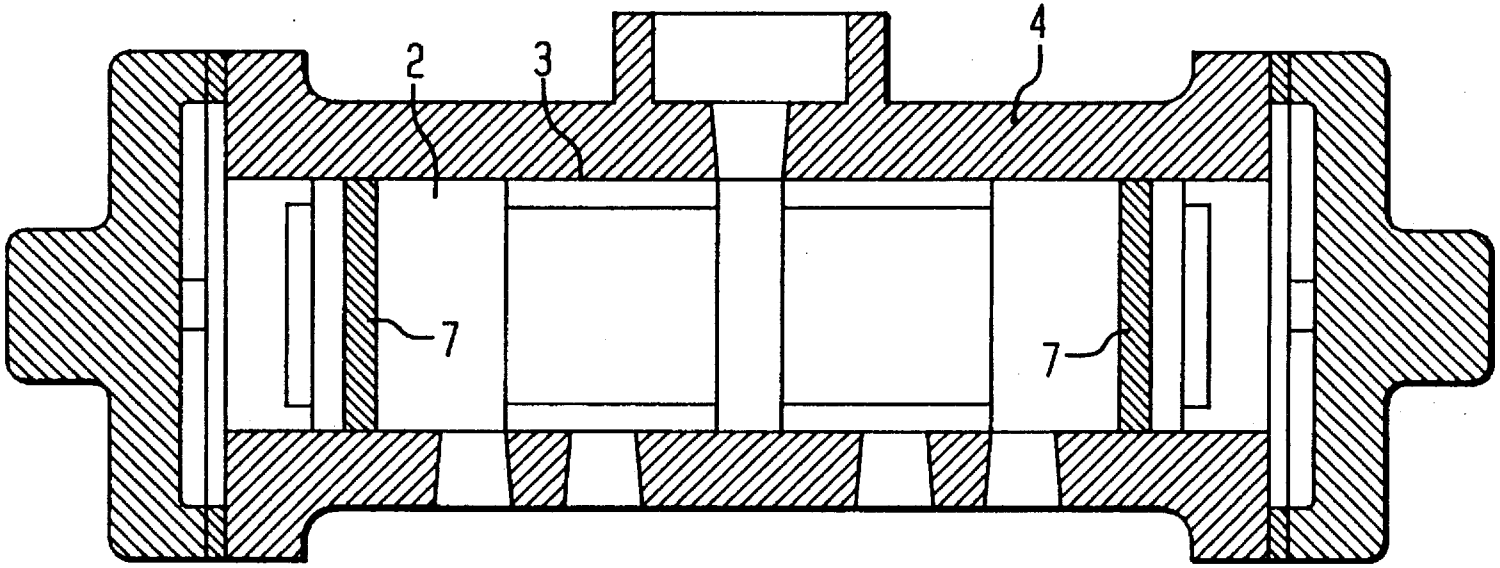
FIG. 2 is an axial, cross-sectional illustration of the main spool or shuttle valve of FIG. 1.

In an axial, cross-sectional view, FIG. 2 depicts the main spool or shuttle valve 2 in the bore 3 of the spool portion of the housing 4, and shows the sealing piston rings 7 disposed about each end of the main spool or shuttle valve 2.

As is somewhat conventional, the main spool or shuttle valve 2 and the pilot spool 5 are used to direct the compressed air supply 9 to work the diaphragms 11 of the pump. The main spool or shuttle valve 2 directs the supply air 9, alternately, to each diaphragm 11, and then to the exhaust muffler 10. The pilot spool 5 is used to shift the main spool or shuttle valve 2.

The pilot spool 5 operates by simultaneously opening and closing four distinct air passageways, namely: two exhaust passageways 8 and two main spool or shuttle valve passageways 12, to control the air flow to and from the main spool or shuttle valve 2 for the purpose of shifting it. The two passageways 12 connect the pilot spool 5 to each end of the main spool or shuttle valve 2. Two other passageways 8 connect the pilot spool to the exhaust.

The travel of the pilot spool 5 can be broken down into three positions of operation: a.) pilot spool 5 centered; with the pump shaft 6 moving axially, an inner diaphragm clamp plate 13 impinges against one extended portion 16 of the pilot spool 5. With the pilot spool being moved to its center position, all supply air 9 to the main spool or shuttle valve 2 is shut off. This is so, as the annular recess 20, formed about the pilot spool 5 has a length which will not bridge across the spaced-apart passageways 12. As can be discerned in FIG. 1, either one of the passageways 12 can be in communication with the recess, or neither thereof. The latter circumstance obtains, with the pilot spool 5 centered in the bore 14. This positioning of the pilot spool 5 prevents pressured air 9 from being directed to both ends of the main spool or shuttle valve 2 at the same time, a condition which would cause the pump to stall.

A next condition of the pilot spool is b.) pilot spool off center to the left; with the pump shaft 6 and the inner diaphragm plate 13 continuing to move, the pilot spool 5 is moved off center. Simultaneously, only one end of the main spool or shuttle valve 2 is opened to the pressured air supply 9, while the opposite end thereof is put in communication with the exhaust 8, 10. The main spool or shuttle valve 2 shifts, causing a reversal of the travel of the pump shaft 6.

There is another condition of the pilot spool 5, to wit: c.) pilot spool off center to the right; the pump shaft 6 continues its reversed travel until the other clamp plate 13 contacts the opposite, extended portion 16 of the pilot spool 5, driving the pilot spool 5 past its center position and into its off center-right positioning. This now reverses the porting 12 to the main spool or shuttle valve 2; the exhaust and supply pressure ends of the main spool or shuttle valve 2 are switched, in effect, causing the main spool or shuttle valve 2 to shift and cause a reverse travel of the pump shaft 6 and diaphragm clamp plates 13.

The cycling is repeated, indefinitely, resulting in continuous pumping action by the double-diaphragm pump.

Functioning of the pilot spool 5 is accomplished by isolating the four air passageways 8 and 12 from one another either through tight radial clearances between the pilot spool and the bore 14, or, as depicted, by utilizing piston rings 15 on the pilot spool 5 to seal to the pilot bore 14.

The invention offers a means for overcoming any requirement for lubrication in the pump; as disclosed herein, no O-rings requiring lubrication, in fact no lubrication of any kind is needed. The main spool or shuttle valve 2 comprehends a non-metallic component; the same can be of plastic or other non-metal material. The main spool or shuttle valve 2 reciprocates in the bore 3, having equal, balanced areas at either ends thereof on which the supply air 9 acts. The main spool or shuttle valve 2 rides on two anti-friction piston rings 7 which provide lifetime, dry lubrication.

Stall-free operation is accomplished by the pilot spool 5 which is actuated by the clamp plates 13, due to translation of the pump shaft 6, and the actuation supplies high pressure air to only one end of the main spool or shuttle valve 2; this, of course, causes the latter to shift in its bore 3. Too, the actuation of the pilot spool 5 maintains high pressure air 9 at one end of the bore 3 until the pump stroke is completed. Centering, or hang-up, of the main spool or shuttle valve 2 is prevented by maintaining high pressure air at one end of the bore 3 through the full pump stroke.

This invention overcomes the shortcomings of the spring-loaded poppet design through elimination of the popper valve closing spring and the "controlled leakage" of this design. The typical, two spring-loaded popper valves and their seats are replaced by a single pilot spool 5. This pilot spool 5, when actuated, remains in an open position during the entire pump stroke, providing sufficient and continuous supply air 9 to guarantee a conplete shift of the main spool or shuttle valve 2. By eliminating the controlled leakage of the prior art designs, inlet air is not lost directly to exhaust 8 before it can reach and effect a complete shift of the main spool or shuttle valve 2. The latter, and the pilot spool 5 act as two distinct air switches which "toggle" between ends of their axial travels.

While we have described our invention in connection with a specific embodiment thereof, it is to be clearly understood that this is done only by way of example, and not as a limitation to the scope of the invention, as set forth in the objects thereof, and in the appended claim.

We claim:

1. A non-lubricated, air actuated, pump-operating, shuttle valve arrangement, in a reciprocating pump, comprising:

a pump housing having a first bore and a second bore formed therein;

a pump-operating shuttle valve slidably disposed in said first bore;

a source of energized air;

a first passageway, formed in said housing, for conducting air from said source to one end of said first bore;

a second passageway, formed in said housing, for conducting air from said source to the opposite end of said first bore;

reciprocating means, interposed between said source and said passageways, for preventing an operative stall of said shuttle valve due to a dead centering thereof, in said first bore, substantially equidistant from said one and said opposite ends of said first bore, said reciprocating means comprising a spool slidably disposed in said second bore, said spool having unitarily formed extended portions at opposite ends thereof; and translating pumping means within said housing, said pumping means, during translation thereof, engaging said unitarily formed portions of said spool, alternatively, causing reciprocation of said spool.

2. A shuttle valve arrangement according to claim 1, wherein:

said spool has an annular recess, formed therein, of a given length, which is in constant communication with said source;

said passageways have terminations which open into said second bore; and said passageway terminations are spaced apart at a distance greater than said given length to insure that said recess, and said source, open into communication with only one of said passageways at any given time.

3. A shuttle valve arrangement, according to claim 1, further including:

sealing means, interposed between said spool and said second bore, for forming variable volume chambers at opposite ends of said second bore.

4. A shuttle valve arrangement, according to claim 3, further including:

third and fourth passageways, formed in said housing, and opening onto said second bore, for venting air from said housing.

5. A shuttle valve arrangement, according to claim 4, wherein:

said third and fourth passageways open onto opposite ends of said second bore, and onto said chambers, for communication with said first and second passageways.

6. A shuttle valve arrangement, according to claim 5, wherein:

said spool comprises opening and closing means cooperative with said second bore for alternatively opening and closing communication of said one and said opposite ends of said first bore, coincident with reciprocation of said spool, with said third and fourth passageways.

* * * * *